US006932018B2

(12) United States Patent
Slattebo

(10) Patent No.: US 6,932,018 B2
(45) Date of Patent: Aug. 23, 2005

(54) MANUAL HYDROFOIL AND SPAR TRUSS ASSEMBLY FOR WIND POWERED WATERCRAFT

(76) Inventor: John Slattebo, 1472 Ozark Rd., Oceanside, CA (US) 92056

( * ) Notice: Subject to any disclaimer, the term of this patent is extended or adjusted under 35 U.S.C. 154(b) by 0 days.

(21) Appl. No.: 10/611,488

(22) Filed: Jul. 1, 2003

(65) Prior Publication Data

US 2004/0089217 A1 May 13, 2004

Related U.S. Application Data

(60) Provisional application No. 60/393,622, filed on Jul. 3, 2002.

(51) Int. Cl.[7] ..... B63B 1/28
(52) U.S. Cl. ..... 114/280; 114/61.23; 114/347
(58) Field of Search ..... 114/39.15, 39.24, 114/61.23, 61.24, 280, 347

(56) References Cited

U.S. PATENT DOCUMENTS

| | | | | | |
|---|---|---|---|---|---|
| 1,709,219 | A | | 4/1929 | Hille | |
| 3,179,078 | A | * | 4/1965 | Popkin | 114/126 |
| 3,286,673 | A | * | 11/1966 | Nason | 114/282 |
| 3,747,549 | A | | 7/1973 | Shutt | |
| 3,802,366 | A | * | 4/1974 | Mankawich | 114/39.24 |
| 4,027,614 | A | * | 6/1977 | Jones | 114/163 |
| 4,208,980 | A | | 6/1980 | Henkel | |
| 4,228,750 | A | * | 10/1980 | Smith et al. | 114/39.24 |
| 4,517,912 | A | | 5/1985 | Jones | |
| 4,541,356 | A | | 9/1985 | Jones et al. | |
| 4,561,371 | A | * | 12/1985 | Kelley et al. | 114/61.22 |
| 4,569,301 | A | * | 2/1986 | Pyburn | 114/61.23 |
| 4,615,291 | A | | 10/1986 | Jones | |
| 4,711,195 | A | | 12/1987 | Shutt | |
| 4,867,719 | A | * | 9/1989 | duPont | 440/101 |
| 5,054,410 | A | | 10/1991 | Scarborough | |
| D322,773 | S | * | 12/1991 | Kissel et al. | D12/302 |
| 5,168,824 | A | * | 12/1992 | Ketterman | 114/276 |
| 5,309,859 | A | | 5/1994 | Miller | |
| 5,520,137 | A | | 5/1996 | Arii et al. | |
| 5,564,955 | A | * | 10/1996 | Ingraham | 440/6 |
| 5,582,126 | A | * | 12/1996 | Rypinski | 114/352 |
| 5,636,585 | A | | 6/1997 | Schulz | |
| 6,024,041 | A | * | 2/2000 | Eglais | 114/274 |

OTHER PUBLICATIONS

Dierking, Schematic for the "T2" outrigger boat found at http://homepages.paradise.net.nz/garyd/t2.html. internet publication date verified by http://www.archive.org as at least as early as Feb. 10, 2001.*

Slattebo, Declaration under Rule 132, 2004, pp. 3.

* cited by examiner

*Primary Examiner*—Andrew D. Wright
(74) *Attorney, Agent, or Firm*—Robert M Hunter

(57) ABSTRACT

A simple, lightweight, manually-controlled device for stabilizing and increasing the performance of small, sail-assisted watercraft, containing a single moving part and comprising a curved spar or iako (1) joining a main hull and a single outrigger hull or ama, a tubular shaft (2) with a handle (7) at one end and an "L" shaped hydrofoil (5 and 6) at the other end. The tubular shaft (2) is joined to the iako (1) by two or more struts (3) that are fixed to the iako (1) at their upper ends and have machine screws (8) or sleeves (4) at their lower ends by means of which the tubular shaft (2) is permitted to rotate around its longitudinal axis and is prevented from moving horizontally in relation to the curved iako (1), thereby making the entire assembly a truss or girder that resists vertical distortion or flexion. The vertical portion of the foil (6) makes an obtuse angle of specified range with the submerged blade portion of the foil (5) so that a horizontal force vector in a windward direction is created by the foil when it moves through the water, regardless of the tack on which the watercraft is sailed. An accessory device for transporting either a single passenger or equipment, consisting of two fore-and-aft rails (9) the ends of which rest on, or snap onto, or are otherwise affixed to the iako (1) and a second iako abaft thereof, and a webbing or fabric sling (10) attached to and suspended between said fore-and-aft rails (9).

10 Claims, 4 Drawing Sheets

MANUAL HYDROFOIL AND SPAR TRUSS ASSEMBLY FOR WIND POWERED WATERCRAFT

CROSS-REFERENCE TO RELATED APPLICATIONS

This application is entitled to the benefit of Provisional Patent Application Ser. No. 60/393,622, filed Jul. 3, 2002.

BACKGROUND

1. Field of the Invention

This invention relates to wind powered or sail assisted watercraft and more particularly those watercraft using a single submerged hydrofoil for stabilization and improved performance.

2. Description of Prior Art

A number of patents have been granted covering hydrofoil devices intended to counteract the heeling moment imparted by wind pressure on the sails and masts of small sailing craft or saiboats. For monohull saiboats, this heeling moment causes the boat to heel or roll around the longitudinal axis of the hull. Those monohull sailboats with a deep and heavy ballast keel typically will heel until deck edge immersion occurs, at with time drag increases dramatically and performance erodes. In some cases, the sailboat may swamp or downflood. (Capsizing is rare, except in heavy seas, as the heeling moment exerted by wind on sails and masts is reduced as the angle of heel increases and wind spills off of sails.) Those monohull sailboats without a deep and heavy ballast keel typically will swamp or capsize. For multihull sailboats, this heeling moment causes the windward hull to rise up relative to the leeward hull and will eventually result in the boat capsizing or "turning turtle."

Patented devices intended to counteract heeling moment using hydrofoil technology are typically complicated mechanical devices involving many moving parts. Most involve two or more foils. Most employ complex sensing and feedback components intended to alter the angle of attack of, and therefore the lift generated by, the foil or foils, depending on the speed of the boat and/or the heeling moment imparted by sail and mast.

None of these existing devices has been successfully applied to address the problem of stabilizing small, lightweight paddling kayaks or canoes such that they can be operated both as high performance, human-powered watercraft and as high performance, wind-powered watercraft. This is because they lack the simplicity of design and construction, the lightness in weight, and the ease of assembly and disassembly required to make them practical and appealing to the owner of the sort of canoe, kayak, or small sailboat that can be transported on the top of a car or other vehicle.

The demand for such a device, and the lack of applicability of existing patented devices, is apparent from the many advertisements contained in magazine for kayakers. These advertisements show a variety of very small sails and twin outrigger floats, both rigid and inflatable, intended to provide the average paddler with an option for a simple, lightweight accessory package allowing wind assistance when a kayak is navigated downwind or with the wind near or abaft the beam. These advertisements clearly show that there is a market or demand for the sort of innovative device that is the subject of this patent application.

A review of existing patents suggests that none incorporates and combines the unique features of the device covered by this patent application: simplicity (single moving part), manual operation, rigidity (truss structure yielded by combining the control spar and the support spar), ease of assembly and disassembly, light weight and ease of transport, and low cost to manufacture.

The Hydrofoil Means for Stabilizing Watercraft in U.S. Pat. No. 3,286,673 to Nason, Nov. 22, 1966, involved three separate hydrofoils mounted on the main hull and to port and starboard of two auxiliary hulls, and dozens of complex moving parts. This device would not be adaptable for use with a small, "car-toppable" canoe, kayak, or sailboat.

The High Speed Sailboat in U.S. Pat. No. 3,747,549 to Shutt, Jul. 24, 1973, uses two horizontal hydrofoils and a "planing surface" that controls automatically the angle of attack of the smaller of the two horizontal foils. The entire device is mounted on an outrigger arm on the windward side of a monohull sailboat and contains dozens of moving parts with multiple levers and pivot points. Moreover, the anti-heeling feature of the foils is augmented by the weight of the operator, who sits on a hiking board and uses his weight to counteract heeling moment. Finally, the forces generated by the foils are not transmitted to hull via a simple truss structure, but rather through a cable that is attached to the top of the mast. The overall result is a complex system of parts unsuitable for weight, complexity, and cost to the problem of stabilizing a car-toppable canoe, kayak, or small sailboat.

The Hydrofoil Sailboat with Control Tiller in U.S. Pat. No. 4,228,750 to Smith, Oct. 21, 1980, is also extremely complex and ill-suited to the problem of stabilizing a car-toppable canoe, kayak, or sailboat. It uses two buoyant hydrofoils connected to, and controlled from, a monohull sailboat through "pairs of spreaders and multiple cables." A sail mounted not on the hull but above the foils is supported by "a plurality of interconnected, prestressed spars" and is controlled and inclined by means of a hand crank.

The Sailboat with Hydrofoil Members in U.S. Pat. No. 5,636,585 to Schultz, Jun. 10, 1997, involves two outriggers to either side of a monohull sailboat and requires that water ballast be pumped into pontoons incorporated into the hydrofoils. The device thus involves many moving parts, cables, spars, pumps, and hoses. It is not suitable for stabilizing a car-toppable canoe, kayak, or small sailboat.

The Catamaran Stabilization Structure in U.S. Pat. No. 4,561,371 to Kelley, Dec. 31, 1985, involves three separate foils mounted on a catamaran with hulls of equal size. It is not suitable for stabilizing car-toppable canoe, kayak, or small sailboat.

The Twin Hull Boat with Hydrofoils in U.S. Pat. No. 5,520,137 to Arii, May 28, 1996, involves the use of multiple foils on a power driven catamaran. It has no applicability to the problem of stabilizing a car-toppable canoe, kayak, or small sailboat.

SUMMARY

The invention is a simple, lightweight, single moving part, manually-operated means of stabilizing and increasing the performance of small, lightweight, wind powered or sail-assisted paddling canoes and/or kayaks and small sailboats. It consists of a hydrofoil in the shape of the letter "L," connected to a straight tubular shaft intended to fix the position of the hydrofoil to one side of the longitudinal axis of the hull of the canoe or kayak or sailboat (hereinafter "watercraft"), such that rotation of the tubular shaft around its long axis will both a) adjust the angle of attack of the hydrofoil when it is submerged and b) allow it to be rotated so that it is completely clear of the water when it is not needed to stabilize the watercraft. An adjustable length handle is affixed to the tubular shaft at a right angle thereto at the end opposite that to which the hydrofoil is affixed. This handle provides a simple and efficient means for the operator of the watercraft to make continuous manual adjustments to the hydrofoil's angle of attack while the watercraft is being sailed.

The tubular shaft portion of the invention is positioned below, slightly abaft, and parallel to the leading or forward most of two curved spars (known as "iakos" on Hawaiian paddling canoes). These two spars (hereinafter "iakos") serve to position a small outrigger hull or floatation chamber (known as an "ama" on Hawaiian paddling canoes and hereinafter referred to as "ama") to one side of, and parallel to, the hull of the watercraft. The ama provides stability to the narrow main hull of the watercraft when it is not making way through the water. When the watercraft is making way through the water under sail propulsion, the ama is elevated slightly (reducing drag), or is raised out of the water, as a result of lift created by the hydrofoil.

The straight tubular shaft of the invention is positioned and supported under, and slightly abaft, the leading or forward-most iako by two short struts that are permanently welded or fixed at their upper ends to the forward-most iako and that attach at their lower ends to the extreme ends of the tubular shaft using machine screws around which the tubular shaft rotates. These machine screws keep the struts in contact with the ends of the tubular shaft, allowing the shaft to rotate around its long axis but otherwise preventing it from moving in relation to the iako.

The combination of the tubular shaft and the curved iako thus forms a truss or girder that resists the tendency of the iako to flex in the vertical plane as heeling forces are applied to the hull by mast and sail. By joining the tubular shaft of the foil assembly to the iako in this manner to form a truss, the diameters of both the shaft and the iako can be kept to a minimum, and the weights of both of these spars can be reduced without sacrificing strength and rigidity. Without the truss arrangement, i.e., if the iako and the foil-controlling tubular shaft are combined as a single tube or shaft, or as concentric tubes or shafts, then the tendency of the shaft or shafts to flex or distort will interfere with foil control and will cause the foil's angle of attack, as well as its vertical and horizontal lift vectors, to change in accordance with the amount of flexion or distortion.

A modified version of the invention adds a strut at or near the middle of both the iako and the tubular shaft. This strut has a sleeve or bearing at its lower end within which the shaft can rotate around its long axis. This strut is positioned where the distance is greatest between the tubular shaft and the iako.

The foil-adjusting tubular shaft is positioned slightly abaft the iako so as to permit the foil to be rotated 180 degrees from its lowered operating position to its fully stowed position without interference from the iako.

The single "L" foil is constructed and positioned in the truss assembly so that the portion of the foil that intersects the surface of the water when the foil is down (reference numeral 6 in FIG. 1) makes an angle of approximately 90 degrees with the plane of the water's surface. The foil is shaped so that the submerged blade portion of the foil that resists heeling moment under sail (reference numeral 5 in FIG. 1) makes an angle of between 100 and 110 degrees with the portion of the foil that intersects the surface of the water.

This angle is an important feature of the invention as it adds a horizontal component or vector to the lift created by the foil when it is moving forward through the water. This horizontal vector improves the windward performance of the watercraft when beating to windward because the direction of this horizontal vector is always toward the windward side of the watercraft regardless of whether it is on port or starboard tack.

The objects and advantages of the invention are:

In a preferred embodiment, the invention is a single, manually-adjustable hydrofoil and spar truss assembly for stabilizing a sail assisted canoe, kayak, or sailboat of less than 25 feet in overall length, comprising: a handle comprising -two pieces of tubing, one of which telescopes into the other permitting the length of said handle to be adjusted; a tubular shaft of between five and 10 feet in length connected to said handle at approximately a right angle thereto; a hydrofoil approximating the shape of the letter "L" consisting of a vertical portion connected to said tubular shaft at approximately a right angle thereto and a submerged blade portion oriented so as to i) make an angle of approximately 90 degrees with said vertical portion of the hydrofoil, ii) be approximately parallel to both the surface of the water and the tubular shaft when in operation, and iii) make an angle of approximately 90 degrees with said handle when in operation and when viewed from above; and a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion. Preferably, the manually-adjustable hydrofoil and spar truss assembly further comprises: another curved, athwartships-oriented, outrigger spar connecting said hulls, and an accessory seat or equipment carrying device intended to carry a single passenger or fishing or camping equipment on, and at or near the highest point of, the spars comprising: two fore-and-aft rails the ends of which rest on, or snap onto, or are otherwise affixed to said spars, and a webbing or fabric sling attached to and suspended between said fore-and-aft rails, such that i) the weight of the device and the contents thereof is distributed evenly between said fore-and-aft rails and at or near the middle of the spars, contributing to the stability of the outrigger canoe, and ii) the device and the contents thereof are positioned at or near the highest point of said spars, insuring that the device and its contents are positioned as far from the water as possible.

In another preferred embodiment, the invention is a single, manually-adjustable hydrofoil and spar truss assembly for stabilizing a sail assisted canoe, kayak, or sailboat of less than 25 feet in overall length, comprising: a handle comprising two pieces of tubing, one of which telescopes into the other permitting the length of said handle to be adjusted; a tubular shaft of between five and 10 feet in length connected to said handle at approximately a right angle thereto; a hydrofoil approximating the shape of the letter "L" consisting of a vertical portion connected to said tubular shaft at approximately a right angle thereto and a submerged blade portion oriented so as to i) be approximately parallel to both the surface of the water and the tubular shaft when in operation and when viewed from above, and ii) make an angle of approximately 90 degrees with said handle when in operation and when viewed from above, and iii) make an angle of between 100 degrees and 110 degrees with said vertical portion of the hydrofoil in order to generate not only upward and downward forces to resist heeling when the canoe, kayak, or sailboat is sailed on both port and starboard tacks, but also a sideways or athwartships force vector that will always be directed toward the windward side of the canoe, kayak, or sailboat when beating to windward, regardless of which tack the vessel is on, thereby increasing the vessel' windward sailing performance; and a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion.

In yet another preferred embodiment, the invention is a single, manually-adjustable hydrofoil and spar truss assembly for stabilizing a sail assisted canoe, kayak, or sailboat of less than 25 feet in overall length, comprising: a handle; a tubular shaft of between five and 10 feet in length connected to said handle at approximately a right angle thereto; a hydrofoil approximating the shape of the letter "L" consisting of a vertical portion connected to said tubular shaft at approximately a right angle thereto and a submerged blade portion oriented so as to i) make an angle of approximately 90 degrees with said vertical portion of the hydrofoil, ii) be approximately parallel to both the surface of the water and the tubular shaft when in operation, and iii) make an angle of approximately 90 degrees with said handle when in operation and when viewed from above; and a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion.

In a further preferred embodiment, the invention is an assembly for stabilizing a vessel having a main hull and an outrigger hull that is attached to the main hull by a spar, said assembly comprising: a shaft having a first longitudinal axis, said shaft being connected to the spar at a first location that is closer to the main hull than to the outrigger hull and at a second location that is closer to the outrigger hull than to the main hull, said shaft being connected to the spar in such a way that said shaft can rotate around said first longitudinal axis over a first angle; a handle having a second longitudinal axis, said handle being fixed to said shaft adjacent to said first location and being oriented at a second angle of approximately 90 degrees to said first longitudinal axis; a hydrofoil that is connected to said shaft adjacent to said second location, said hydrofoil having a first portion having a third longitudinal axis that is oriented at a third angle of about 90 degrees to said first longitudinal axis and at a fourth angle of about 90 degrees to a line substantially parallel to said second longitudinal axis, said hydrofoil further having a second portion that is fixed to said first portion and that is oriented at a fifth angle of between about 100 degrees and 110 degrees to said third longitudinal axis. Preferably, the spar is curved upward between the main hull and the outrigger hull and said shaft is straight and wherein the distance between said first location and said second location is fixed by the manner in which said shaft is connected to said spar at said locations, said spar and shaft thereby forming a truss that effectively stiffens said spar. Preferably, said handle comprises two portions, one of which portions telescopes into the other, thereby rendering the length of said handle adjustable. Preferably, the outrigger hull is attached to the main hull by two spars, said assembly further comprising: a sidecar comprising a frame having two rails with ends that connect to the two spars and a sling that attaches to said frame between said rails.

A further object and advantage of the invention is to provide a location (between the two iakos) where an accessory (called a "sidecar") can be easily mounted that will carry either a passenger or camping and fishing equipment. This sidecar consists of a frame (composed of two fore and aft rails that snap onto and bridge the gap between the two iakos) and a webbing or fabric sling attached to the frame. The curved iakos suspend the sidecar well above the water, and the use of an ama or outrigger with approximately 200 lbs. of floatation insures that the presence of an adult in the sidecar will not sink the ama when it is not making way through the water.

Further objects and advantages of the invention will become apparent from a consideration of the drawings and following description.

DRAWING FIGURES

REFERENCE NUMERALS IN DRAWINGS

Figure 1:
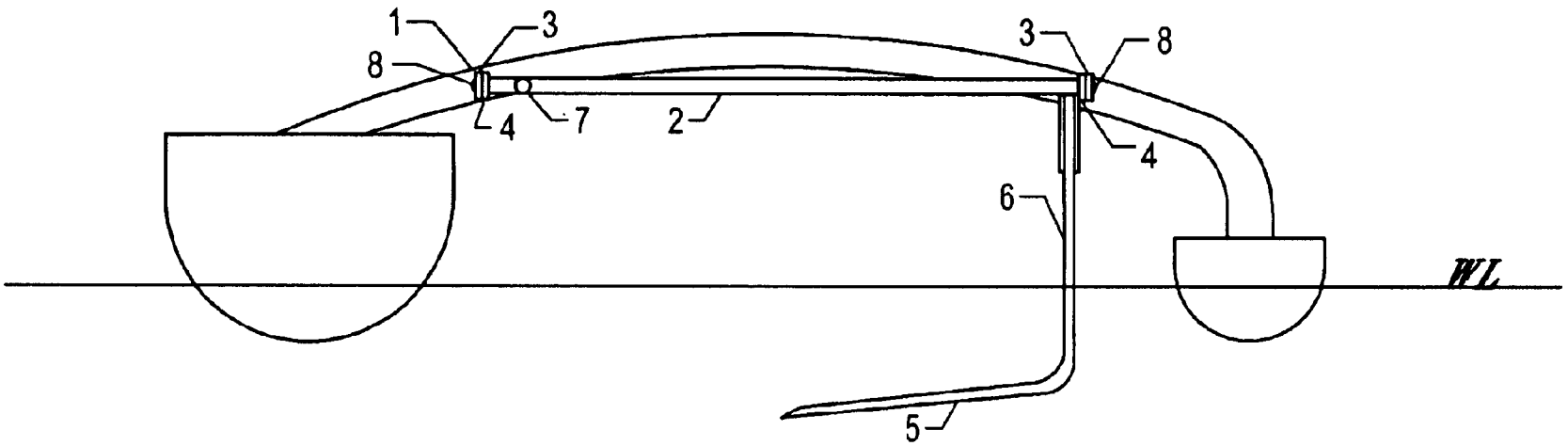
FIG. 1 is a view of the truss assembly from aft or astern of the watercraft showing the assembly's relationship to the main hull and the ama.

1 iako
2 tubular shaft
3 struts

4 sleeves

5 submerged blade portion of foil

6 vertical portion of foil

7 foil adjusting tube or handle

8 machine screws

9 sidecar rails

10 sidecar sling

DESCRIPTION OF INVENTION

FIG. 1 is a view of the truss assembly from aft or astern of the watercraft showing the assembly's relationship to the main hull and the ama. The vertical relationship between the iako (1) and the tubular shaft (2) is apparent from this view. The position of the tubular shaft (2) relative to the iako (1) is maintained by means of short struts (3) that are welded or otherwise fixed to the iako (1) at their upper ends and that are attached to the tubular shaft at their lower ends either by means of two machine screws (8) that pass through holes in the struts and fasten into the ends of the tubular shaft, or by means of a sleeve (4) within which the tubular shaft can rotate. The tubular shaft (2) can rotate around its long axis within this sleeve (4), with the machine screws (8) rotating in holes bored in the struts (3). This rotation causes the angle of attack of the submerged blade portion (5) of the "L" foil to change, thereby creating a downward or upward force to be exerted on the iako (1) when the watercraft is making way through the water. This force counteracts the heeling moment caused by the sail and mast.

Although the tubular shaft (2) can rotate around the long axes of the machine screws (8) and within the sleeve (4), the tubular shaft (2) is prevented from moving horizontally from left to right or from right to left (or athwartships from port to starboard or from starboard to port) because the ends of the tubular shaft are held against the struts (3) by the machine screws (8). Because this horizontal or athwartships movement is prevented, the iako (1) and tubular shaft (2) assembly functions as a truss and prevents or inhibits the iako (1) from flexing up and down when the watercraft is sailed at high speeds or in high winds or rough seas.

FIG. 1 also shows the angle the submerged blade portion (5) of the "L" foil makes with the vertical portion of the foil (6). Because this angle is greater than 90 degrees, a horizontal force vector is created that tends to move the watercraft to windward when beating regardless of which tack the watercraft is on.

FIG. 1 is not drawn to scale.

Figure 2:
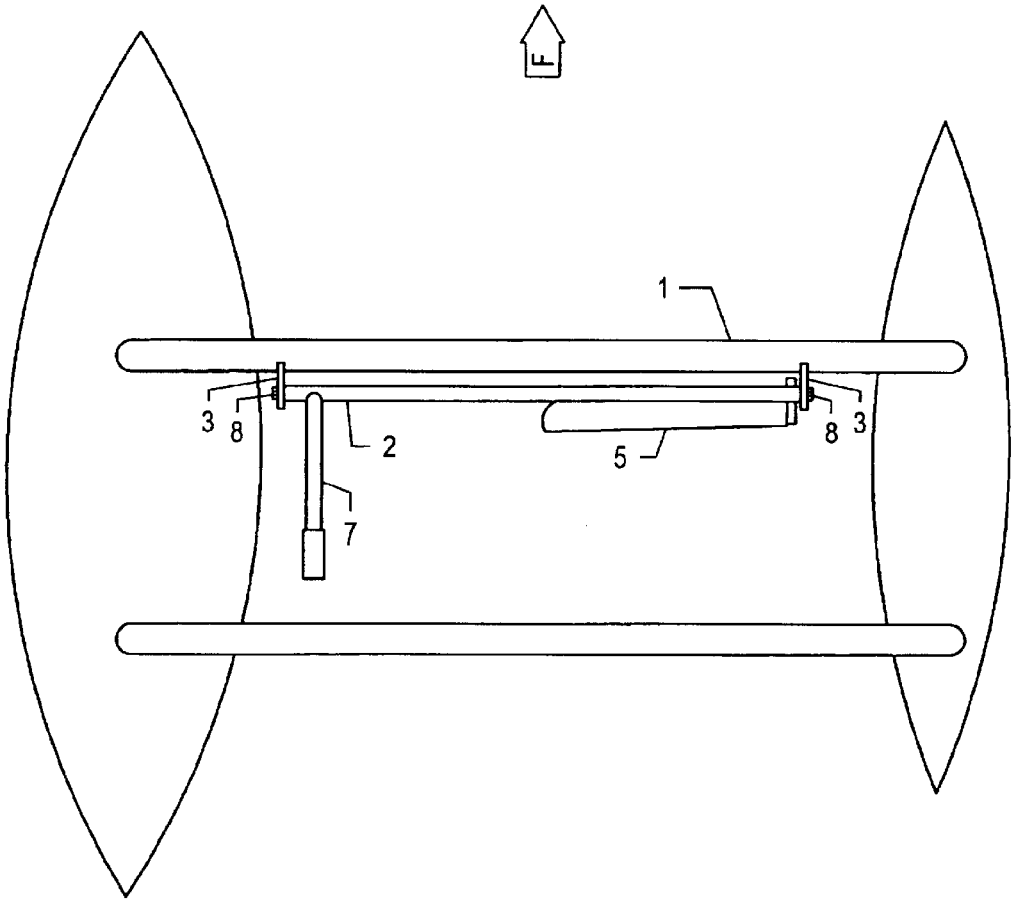
FIG. 2 is a view of the truss assembly from directly above the watercraft showing the assembly's relationship to the main hull and the ama.

FIG. 2 is a view of the truss assembly from directly above the watercraft showing the assembly's relationship to the main hull and the ama. This view shows that the tubular shaft (2) and struts (3) are positioned slightly abaft the iako (1) in order to permit the "L" foil to be rotated nearly 180 degrees to its stowed position out of the water and above the iako (1).

FIG. 2 also shows the foil adjusting tube or handle (7) that the watercraft's operator uses to make manual, continuous adjustments to the angle of attack of the foil when the watercraft is making way through the water under sail.

FIG. 2 is not drawn to scale, nor is the aftermost of the two iakos shown.

Figure 3:
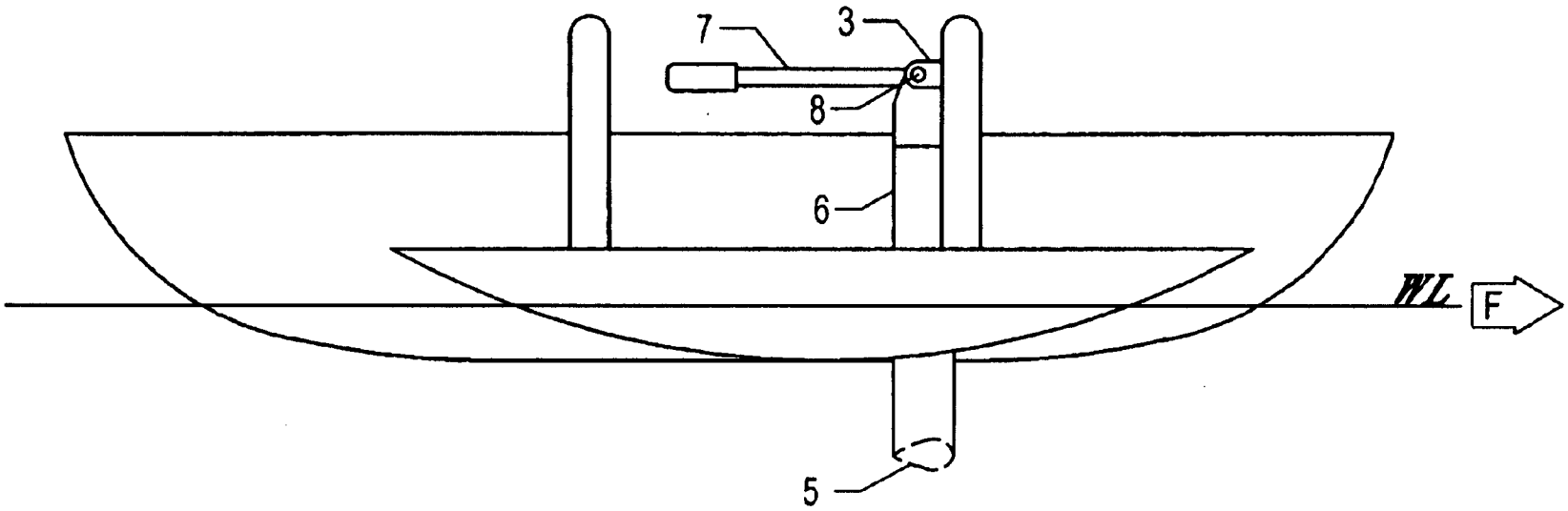
FIG. 3 is a view of the truss assembly from the starboard side of the watercraft showing the assembly's relationship to the main hull and the ama.

FIG. 3 is a view of the truss assembly from the starboard side of the watercraft showing the assembly's relationship to the main hull and the ama. The submerged blade portion (5) of the "L" foil is shown in the down or sailing position, and the foil adjusting tube or handle (7) is shown in the neutral or zero degree angle of attack position.

FIG. 3 is not drawn to scale, nor is the aftermost of the two iakos shown.

Figure 4:
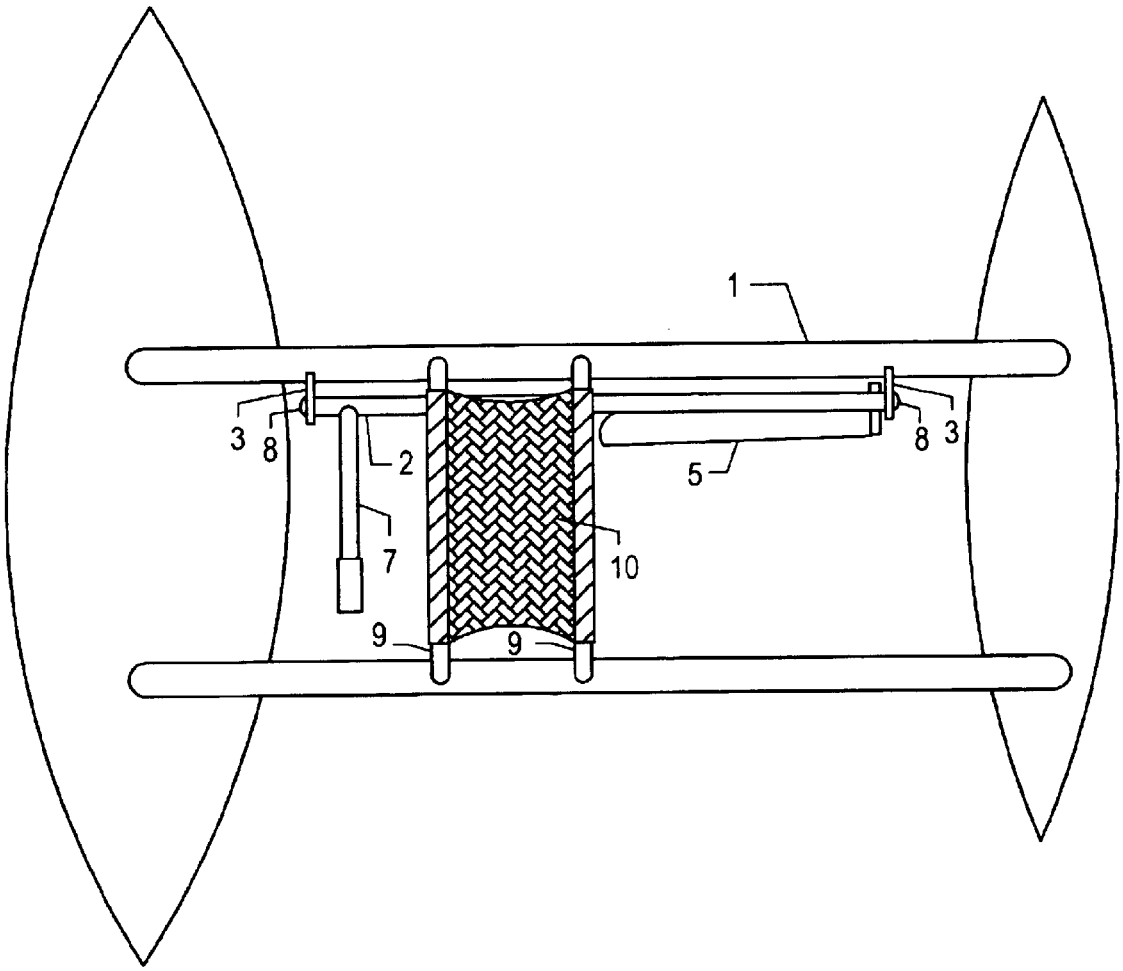
FIG. 4 is a view of a typical watercraft from above, showing the relative positions of the main hull and ama, the positions of the iakos and truss assembly, and the position of the sidecar accessory, which is composed of two fore and aft rails and a sling suspended between the rails.

FIG. 4 is a view of a typical watercraft from above, showing the relative positions of the main hull and ama, both iakos (1), the tubular shaft (2), the submerged blade portion of the foil (5), the foil adjusting tube or handle (7), and the sidecar accessory consisting of two rails (9) that snap onto the iakos (1) and a fabric or webbing sling (10) that can be used to carry a passenger or equipment for camping or fishing.

Operation

The invention is used when the watercraft to which it is affixed is making way through the water under sail power. Prior to getting underway, the operator grasps the foil adjusting tube or handle (FIG. 2, reference number 7) and moves it so that the submerged blade portion of the foil (FIGS. 1, 2, and 3, reference number 5) is positioned under the ama. When the submerged blade portion of the foil is so positioned, the foil adjusting tube or handle will be approximately horizontal and parallel with the surface of the water, with the end of the foil adjusting tube or handle extending directly aft from the tubular shaft (FIG. 2, reference number 2). The operator then adjusts the length of the foil adjusting tube or handle so that it can be held comfortably in his or her right hand and moved up or down with small movements of the hand, wrist or lower portion of the arm.

As the watercraft begins to make way, the operator moves the foil adjusting tube or handle slightly upward (when sailing on the starboard tack) or downward (when sailing on the port tack) so as to counteract the heeling moment, imposed by pressure of the wind on sail and mast, in order to position the bottom of the ama at or near the surface of the water. The operator then moves the handle up or down as necessary to keep the ama at or near the water's surface while minimizing drag and opposing the tendency of the heeling moment imparted by mast and sail to a) further lift the ama when the watercraft is on the starboard tack, or b) cause the ama to immerse beyond its normal waterline and thereby cause excessive drag when the watercraft is on the port tack.

When the watercraft is being sailed to windward on the port tack, the operator maintains a slight downward pressure on the handle so that the angle of attack of the submerged foil is slightly above horizontal, creating a lift effect. Because the submerged blade portion of the foil (FIG. 1, reference number 5) makes an angle of between 100 degrees and 110 degrees with the vertical portion of the foil (FIG. 1, reference number 6), the foil will also generate a force vector toward the port or windward side of the watercraft, thereby helping the windward performance of the watercraft.

When the watercraft is being sailed to windward on the starboard tack, the operator maintains a slight upward pressure on the handle so that the angle of attack of the submerged foil is slightly below horizontal, creating a downward force. Because the submerged blade portion of the foil (FIG. 1, reference number 5) makes an angle of between 100 degrees and 110 degrees with the vertical portion of the foil (FIG. 1, reference number 6), the foil will also generate a force vector toward the starboard or windward side of the watercraft, thereby helping the windward performance of the watercraft.

The forces of the wind on mast and sail, and of waves on the watercraft's main hull, will have a roll component, which will be transmitted to the submerged foil by means of the iako and tubular shaft. As the foil resists this roll component, the iako and tubular shaft will have a tendency to flex or deflect. However, because the iako and tubular shaft are joined in a manner that creates a truss, this flexion or deflection is kept to a minimum, and there will be minimal interference with smooth and precise manual adjustments to the angle of attack of the foil.

The curvature of the iakos, a feature that allows the forward iako to form a rigid truss when combined with the tubular shaft that controls the foil, also allows the iakos, at their mid points, sufficient clearance above the water to provide a suitable location for the addition of the sidecar accessory. This accessory, which is mounted on the two iakos near their midpoints, is suitable for carrying a single passenger or, alternatively, either camping or fishing gear. Positioning the passenger or camping or fishing gear in this location increases the stability of the watercraft when it is under sail on the starboard tack, because the weight of the passenger or camping or fishing gear is to starboard, or to windward, of the main hull when on such tack.

Conclusion, Ramifications, and Scope of Invention

The reader will appreciate that simplicity (single moving part), rigidity (due to truss configuration), asymmetry (outrigger and foil/truss assembly carried to one side only), and lightness are design features of this invention that are collectively the key to solving a longstanding problem confronted by the designers of canoes, kayaks, and small (i.e., "car-toppable") watercraft: How does one add sufficient sail area to a canoe, kayak, or other light weight watercraft so as create a high performance sailing boat without a) sacrificing performance as a human-powered (i.e., paddled) craft, b) making the craft unstable and prone to capsize, c) making it stable when overturned and therefore difficult for a person in the water to right d) making it excessively heavy, e) making it difficult to assemble and transport, or f) making it expensive to manufacture.

Other attempts to solve this problem through the use of outrigger hulls or floats mounted to both port and starboard of the main hull, or through the use of one or more hydrofoils with complex, roll-sensing or roll-compensating foil control devices, have resulted in watercraft with one or more of the following undesirable characteristics: a) they are relatively heavy, generating excessive drag when they are propelled by paddles alone, b) they are unstable and prone to capsize in moderate wind and/or sea conditions, c) they have two hulls of equal floatation (catamaran) or three hulls with the outer two having equal floatation (trimaran), making the craft stable when overturned and therefore difficult for a single person in the water to right, d) they are too large and/or heavy for transport on the top of a car and for unloading and launching by a single person, e) they are complex with many moving parts, making them difficult to assemble and disassemble, or f) they are complex with many moving parts, making them expensive to manufacture.

The affixing of this simple but ingenious invention to a watercraft that is essentially a Hawaiian style paddling canoe on which a fixed mast and sail has been mounted results in a recreational watercraft that is unique in a number of very significant respects:

It is small enough and light enough to be carried on the top of a car. This means its owner/operator needs no trailer for transporting, can park a transporting vehicle anywhere a car can park, and can launch and recover from any beach without the need for access to a launching ramp.

It results in a watercraft that has performance under sail approaching that of a windsurfer but that any person can learn to operate in a half hour or less.

It results in a watercraft that performs like the typical catamaran that requires a trailer to transport, but it is far easier to right when overturned in the water.

It results in a watercraft that when reaching or running performs like the typical catamaran that requires a trailer to transport, but it outperforms such a catamaran when beating to windward, and it is dramatically easier to tack.

It results in a high performance sailing watercraft that can be paddled when there is no wind and that when paddled approximates the performance of a Hawaiian paddling canoe. It therefore should appeal to those recreational users who are interested in being able to get a physical workout while on the water.

It results in a watercraft that performs well whether powered by sail or by paddle and that can be changed instantly, while underway, from one form of propulsion to the other. This means that it is particularly well suited for one-design class competition, or two-boat match racing, where both sailing skill and aerobic physical fitness are needed. This should give it tremendous appeal to serious athletes interested in water sports.

It results in a one-person watercraft, capable of transport on the top of a car, that can be easily converted to a two-person watercraft through the addition of the sidecar accessory. Due to the curved truss design of the invention, the sidecar and its passenger are carried in a position that keeps them above the water and that adds to the stability of the watercraft.

It results in a one-person sailing and human-powered watercraft, capable of transport on the top of a car, that can be easily converted to a watercraft suitable for offshore fishing through the addition of the sidecar accessory. Fishing from Hawaiian-style canoes and kayaks is becoming increasingly popular, but the typical canoe or kayak is either unstable as a fishing platform or lacks stowage space for fishing gear. A Hawaiian-style paddling canoe fitted with this invention and the sidecar accessory successfully solves both the stability and stowage problems of existing canoes and kayaks.

It results in a one-person sailing and human-powered watercraft, capable of transport on the top of a car, that can be easily converted to a watercraft suitable for offshore distance expeditions through the addition of the sidecar accessory.

Offshore expedition or distance kayaking is one of the fastest growing water sports in the United States according to the National Sporting Goods Association. The kayaks used for this activity have storage compartments in the hull. A brief look at the advertisements in magazines published for kayak enthusiasts will show that a demand exists for sails and outrigger float assemblies for expedition kayaks to give them greater range, through sail assist, when they are operated in light to moderate wind conditions. The adding of a sidecar accessory to a Hawaiian-style paddling canoe fitted with the hydrofoil and spar truss assembly results in a watercraft ideal for offshore distance expeditions. When fitted with a sail that rolls up on the mast, and with a mast that can be easily removed and stowed on top of both iakos alongside the sidecar accessory, a watercraft using this hydrofoil and spar truss assembly becomes the ideal, versatile expedition, car-toppable watercraft. A waterproof camping gear bag is lashed into the sidecar sling where it is easily accessed and where it contributes to the stability of the watercraft.

What is claimed is:

1. A single, manually-adjustable hydrofoil and spar truss assembly for stabilizing a sail assisted canoe, kayak, or sailboat of less than 25 feet in overall length, comprising:

a. a handle comprising two pieces of tubing, one of which telescopes into the other permitting the length of said handle to be adjusted, b. a tubular shaft of between five and 10 feet in length connected to said handle at approximately a right angle thereto, c. a hydrofoil approximating the shape of the letter "L" consisting of a vertical portion connected to said tubular shaft at approximately a right angle thereto and a submerged blade portion oriented so as to i) make an angle of approximately 90 degrees with said vertical portion of the hydrofoil, ii) be approximately parallel to both the surface of the water and the tubular shaft when in operation, and iii) make an angle of approximately 90 degrees with said handle when in operation and when viewed from above, and d. a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion.

2. The manually-adjustable hydrofoil and spar truss assembly of claim 1, further comprising:

another curved, athwartships-oriented, outrigger spar connecting said hulls, and an accessory seat or equipment carrying device intended to carry a single passenger or fishing or camping equipment on, and at or near the highest point of, the spars, comprising:

a. two fore-and-aft rails the ends of which rest on, or snap onto, or are otherwise affixed to said spars, and b. a webbing or fabric sling attached to and suspended between said fore-and-aft rails, such that i) the weight of the device and the contents thereof is distributed evenly between said fore-and-aft rails and at or near the middle of the spars, contributing to the stability of the outrigger canoe, and ii) the device and the contents thereof are positioned at or near the highest point of said spars, insuring that the device and its contents are positioned as far from the water as possible.

3. A single, manually-adjustable hydrofoil and spar truss assembly for stabilizing a sail assisted canoe, kayak, or sailboat of less than 25 feet in overall length, comprising:

a. a handle comprising two pieces of tubing, one of which telescopes into the other permitting the length of said handle to be adjusted, b. a tubular shaft of between five and 10 feet in length connected to said handle at approximately a right angle thereto, c. a hydrofoil approximating the shape of the letter "L" consisting of a vertical portion connected to said tubular shaft at approximately a right angle thereto and a submerged blade portion oriented so as to i) be approximately parallel to both the surface of the water and the tubular shaft when in operation and when viewed from above, and ii) make an angle of approximately 90 degrees with said handle when in operation and when viewed from above, and iii) make an angle of between 100 degrees and 110 degrees with said vertical portion of the hydrofoil in order to generate not only upward and downward forces to resist heeling when the canoe, kayak, or sailboat is sailed on both port and starboard tacks, but also a sideways or athwartships force vector that will always be directed toward the windward side of the canoe, kayak, or sailboat when beating to windward, regardless of which tack the vessel is on, thereby increasing the vessels' windward sailing performance, and d. a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion.

4. A single, manually-adjustable hydrofoil and spar truss assembly for stabilizing a sail assisted canoe, kayak, or sailboat of less than 25 feet in overall length, comprising:

a. a handle, b. a tubular shaft of between five and 10 feet in length connected to said handle at approximately a right angle thereto, c. a hydrofoil approximating the shape of the letter "L" consisting of a vertical portion connected to said tubular shaft at approximately a right angle thereto and a submerged blade portion oriented so as to i) make an angle of approximately 90 degrees with said vertical portion of the hydrofoil, ii) be approximately parallel to both the surface of the water and the tubular shaft when in operation, and iii) make an angle of approximately 90 degrees with said handle when in operation and when viewed from above, and d. a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion.

5. A single, manually-adjustable hydrofoil and spar truss assembly for stabilizing a sail assisted canoe, kayak, or sailboat of less than 25 feet in overall length, comprising:

a. a handle, b. a tubular shaft of between five and 10 feet in length connected to said handle at approximately a right angle thereto, c. a hydrofoil approximating the shape of the letter "L" consisting of a vertical portion connected to said tubular shaft at approximately a right angle thereto and a submerged blade portion oriented so as to i) be approximately parallel to both the surface of the water and the tubular shaft when in operation and when viewed from above, and ii) make an angle of approximately 90 degrees with said handle when in operation and when viewed from above, and iii) make an angle of between 100 degrees and 110 degrees with said vertical portion of the hydrofoil in order to generate not only upward and downward forces to resist heeling when the canoe, kayak, or sailboat is sailed on both port and starboard tacks, but also a sideways or athwartships force vector that will always be directed toward the windward side of the canoe, kayak, or sailboat when beating to windward, regardless of which tack the vessel is on, thereby increasing the vessels' windward sailing performance, and d. a means of positioning said tubular shaft between a main hull of the canoe, kayak, or small sailboat and a small outrigger hull, such that the tubular shaft remains at approximately a 90 degree angle to the longitudinal axes of both hulls, comprising i) a curved, athwartships-oriented, outrigger spar connecting said hulls, ii) two or more struts fixed to the spar at their upper ends and having machine screws or a sleeve at their lower ends by means of which the tubular shaft is permitted to rotate around its longitudinal axis, and is prevented from moving longitudinally in relation to the spar, such that the entire assembly of the handle, the hydrofoil, the tubular shaft, the spar, the struts and the machine screws/sleeve has but a single moving part that permits continuous manual adjustment of the angle of attack of the hydrofoil, and that forms a truss that is strong and light and is resistant to vertical flexion or distortion.

6. An assembly for stabilizing a vessel having a main hull and an outrigger hull that is attached to the main hull by a spar, said assembly comprising:

a shaft having a first longitudinal axis, said shaft being connected to the spar at a first location that is closer to the main hull than to the outrigger hull and at a second location that is closer to the outrigger hull than to the main hull, said shaft being connected to the spar in such a way that said shaft can rotate around said first longitudinal axis over a first angle;

a handle having a second longitudinal axis, said handle being fixed to said shaft adjacent to said first location and being oriented at a second angle of approximately 90 degrees to said first longitudinal axis;

a hydrofoil that is connected to said shaft adjacent to said second location, said hydrofoil having a first portion having a third longitudinal axis that is oriented at a third angle of about 90 degrees to said first longitudinal axis and at a fourth angle of about 90 degrees to a line substantially parallel to said second longitudinal axis, said hydrofoil further having a second portion that is fixed to said first portion and that is oriented at a fifth angle of between about 100 degrees and 110 degrees to said third longitudinal axis.

7. The assembly of claim 6 wherein the spar is curved upward between the main hull and the outrigger hull and said shaft is straight and wherein the distance between said first location and said second location is fixed by the manner in which said shaft is connected to said spar at said locations, said spar and shaft thereby forming a truss that effectively stiffens said spar.

8. The assembly of claim 6 wherein said handle comprises two portions, one of which portions telescopes into the other, thereby rendering the length of said handle adjustable.

9. The assembly of claim 6 wherein the outrigger hull is attached to the main hull by two spars, said assembly further comprising:

a sidecar comprising a frame having two rails with ends that connect to the two spars and a sling that attaches to said frame between said rails.

10. An assembly for stabilizing a vessel having a main hull and an outrigger hull that is attached to the main hull by a curved spar, said assembly comprising:

a substantially straight shaft having a first longitudinal axis, said shaft being connected to the spar at a first location that is closer to the main hull than to the outrigger hull and at a second location that is closer to the outrigger hull than to the main hull, said shaft being connected to the spar in such a way that said shaft can pivot around said first longitudinal axis;

a handle having a second longitudinal axis, said handle being fixed to said shaft adjacent to said first location;

a hydrofoil that is connected to said shaft adjacent to said second location, said hydrofoil having a first portion having a third longitudinal axis that is oriented at an angle of about 90 degrees to said first longitudinal axis, said hydrofoil further having a second portion that is fixed to said first portion and that is oriented at a second angle of greater than 90 degrees to said third longitudinal axis.

* * * * *